US008629749B2

(12) United States Patent
Chiu

(10) Patent No.: US 8,629,749 B2
(45) Date of Patent: Jan. 14, 2014

(54) FUSE ASSEMBLY

(76) Inventor: Hung-Chih Chiu, Taipei Hsien (TW)

( * ) Notice: Subject to any disclaimer, the term of this patent is extended or adjusted under 35 U.S.C. 154(b) by 350 days.

(21) Appl. No.: 12/957,365

(22) Filed: Nov. 30, 2010

(65) Prior Publication Data

US 2012/0133478 A1 May 31, 2012

(51) Int. Cl.
*H01H 85/165* (2006.01)

(52) U.S. Cl.
USPC ..... 337/228; 337/159; 337/180; 337/181; 337/186; 337/187; 337/251

(58) Field of Classification Search
USPC ..... 337/228, 159, 180, 181, 186, 187, 251
See application file for complete search history.

(56) References Cited

U.S. PATENT DOCUMENTS

| | | | | | |
|---|---|---|---|---|---|
| 4,511,875 | A * | 4/1985 | Arikawa | 337/201 |
| 4,570,147 | A * | 2/1986 | Ebi | 337/166 |
| 4,608,548 | A * | 8/1986 | Borzoni | 337/201 |
| 4,894,633 | A * | 1/1990 | Holtfreter | 337/278 |
| 5,101,187 | A * | 3/1992 | Yuza | 337/278 |
| 5,229,739 | A * | 7/1993 | Oh et al. | 337/290 |
| 5,293,147 | A * | 3/1994 | Oh et al. | 337/227 |
| 5,398,015 | A * | 3/1995 | Kudo et al. | 337/255 |
| 5,606,301 | A * | 2/1997 | Ishimura | 337/290 |
| 5,726,620 | A * | 3/1998 | Arikawa | 337/227 |
| 5,854,583 | A * | 12/1998 | Falchetti | 337/290 |
| 6,067,004 | A * | 5/2000 | Hibayashi et al. | 337/227 |
| 6,275,135 | B1 * | 8/2001 | Hibayashi et al. | 337/227 |
| 6,486,766 | B1 * | 11/2002 | Reid et al. | 337/186 |
| 8,203,420 | B2 * | 6/2012 | Wiryana et al. | 337/232 |
| 2010/0194519 | A1 * | 8/2010 | Harris et al. | 337/227 |
| 2010/0245025 | A1 * | 9/2010 | de Leon et al. | 337/290 |
| 2010/0328020 | A1 * | 12/2010 | Wiryana et al. | 337/232 |

* cited by examiner

*Primary Examiner* — Anatoly Vortman
(74) *Attorney, Agent, or Firm* — Leong C. Lei

(57) ABSTRACT

The fuse assembly contains a first casing member with a first chamber, and a second casing member with a second chamber. An enclosed space is thereby formed by joining the first and second casing members together. A disconnection member is sandwiched between the first and second casing members. The disconnection member contains two electrodes and a fuse element between the two electrodes. Each electrode contains a first lateral section, a vertical section, and a second lateral section, jointly and integrally forming a C-like shape. The electrodes are positioned at two opposing ends of the second casing member and the fuse element is housed in the enclosed space. The enclosed space allows the fuse element to break off completely, thereby avoiding electrical arc and achieving enhanced usage safety.

3 Claims, 8 Drawing Sheets

FUSE ASSEMBLY

TECHNICAL FIELD OF THE INVENTION

The present invention generally relates to fuse devices, and especially relates to a fuse assembly capable of avoiding electrical arc and providing reliable electrical conduction.

DESCRIPTION OF THE PRIOR ART

A conventional fuse assembly contains a cover, two electrodes, a fuse filament, and a base. Each electrode contains a top piece, a side piece, and a bottom piece that are welded together. The fuse filament's two ends are connected to the electrodes, respectively. The electrodes are then positioned at two opposing ends of the base. The cover is stacked on the base and the fuse filament is therefore sandwiched between the cover and the base.

The conventional fuse assembly has the following disadvantages. First, as the cover and base are solid, the fuse filament may fail to completely break off when it fuses and as such electrical arc may occur, leading to operational hazards. Additionally, the electrode's top, side, and bottom pieces are joined together by welding and they may be broken during usage, thereby causing bad contact.

SUMMARY OF THE INVENTION

Therefore, a novel fuse assembly is provided to obviate the foregoing electrical arc and bad contact problems.

The fuse assembly of the present invention contains a first casing member with a first chamber, and a second casing member with a second chamber. An enclosed space is thereby formed by joining the first and second casing members together. A disconnection member is sandwiched between the first and second casing members. The disconnection member contains two electrodes and a fuse element between the two electrodes. Each electrode contains a first lateral section, a vertical section, and a second lateral section, jointly and integrally forming a C-like shape. The electrodes are positioned at two opposing ends of the second casing member and the fuse element is housed in the enclosed space.

The present invention has the following advantages. First, the enclosed space allows the fuse element to break off completely, thereby avoiding electrical arc and achieving enhanced usage safety.

In addition, the electrodes are integrally formed without using welding. Therefore, there is no broken electrode and bad contact problems.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
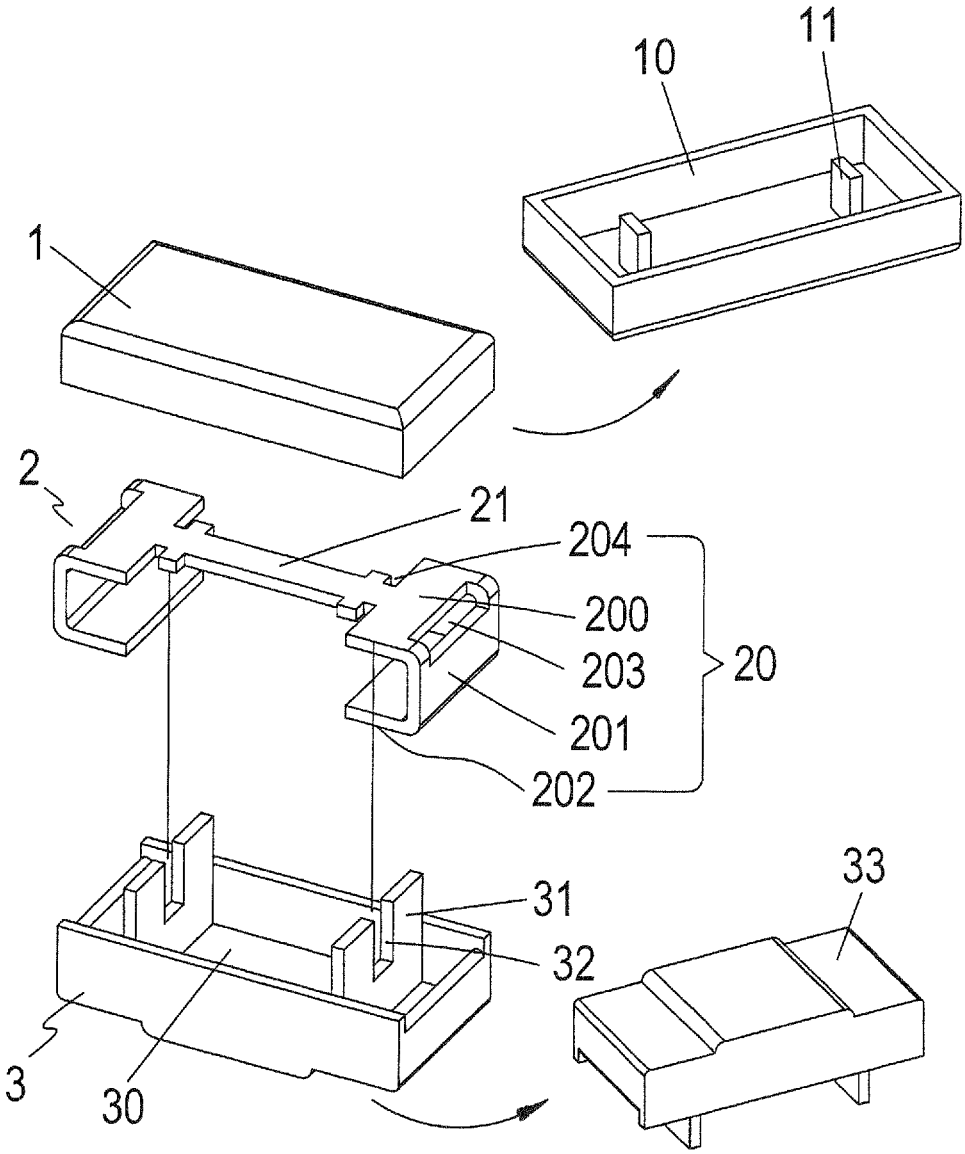
FIG. 1 is a perspective break-down diagram showing the various components of a fuse assembly according to a first embodiment of the present invention.

As shown in FIG. 1, a fuse assembly according to a first embodiment of the present invention contains a first casing member 1, a disconnection member 2, and a second casing member 3.

The first casing member 1 is a cover forming a first chamber 10 with an open bottom. Inside the first chamber 10, there are two parallel, opposing, and downward extending pressing pieces 11.

The disconnection member 2 contains two electrodes 20 and a fuse element 21 between the two electrodes 20. Each electrode 20 contains a first lateral section 200, a vertical section 201, and a second lateral section 202, jointly and integrally forming a C-like shape. The electrodes 20 are positioned so that the gaps of their C-shapes face each other. A notch 203 is provided along the right-angled junction between the first lateral section 200 and the vertical section 201. At the junction between each end of the fuse element 21 and the first lateral section 200 of an electrode 20, two opposing slits 204 are provided, thereby forming a neck section between the fuse element 21 and the first lateral section 200.

Figure 2:
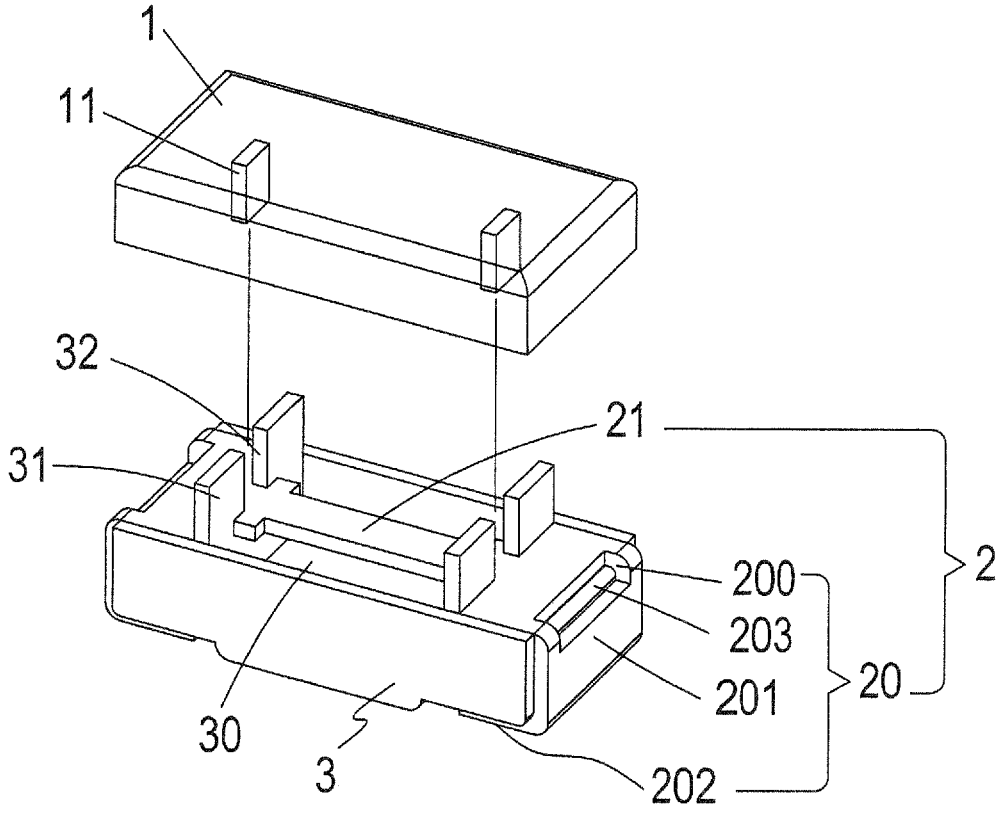
FIG. 2 is a perspective diagram showing the fuse assembly of FIG. 1 with a first casing member being separated.
Figure 3:
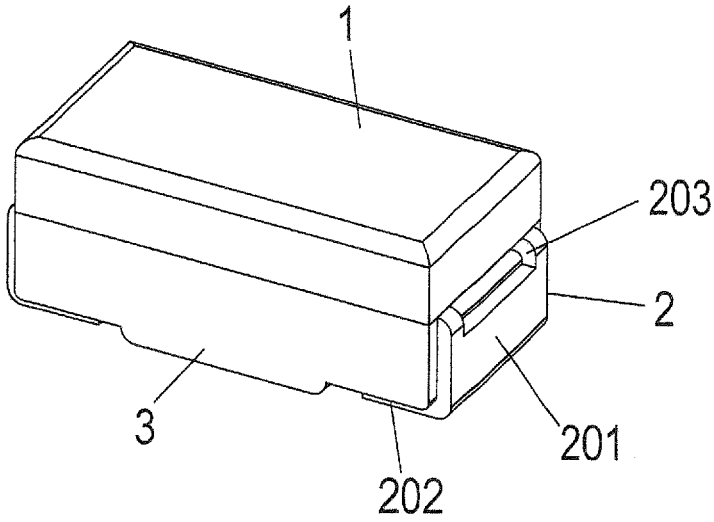
FIG. 3 is a perspective diagram showing the fuse assembly of FIG. 1 after its assembly.
Figure 4:
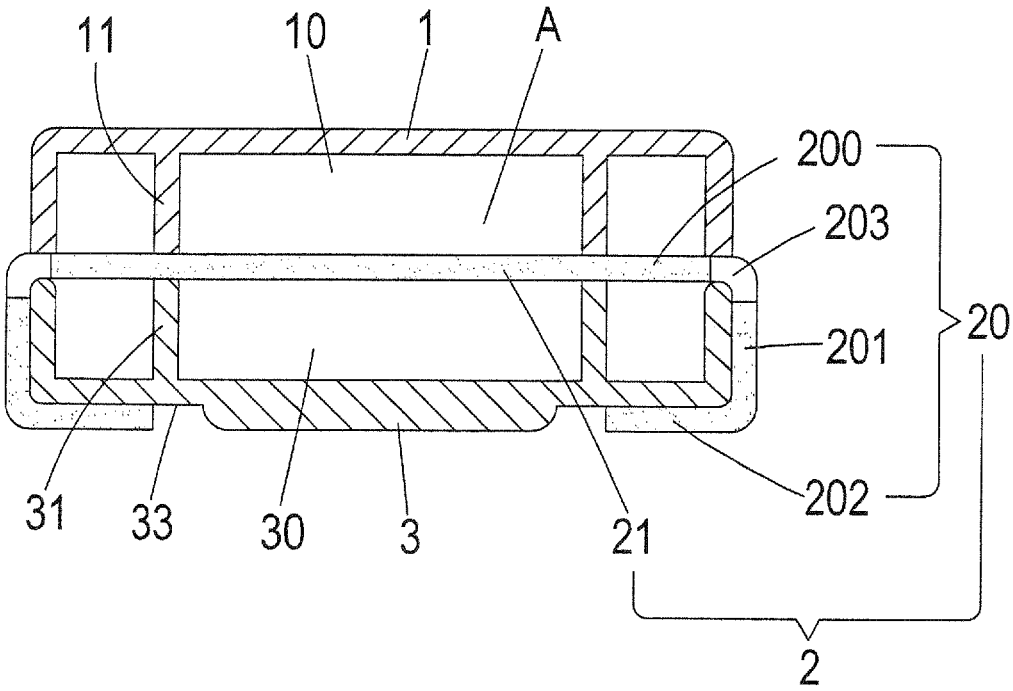
FIG. 4 is a schematic sectional diagram showing the fuse assembly of FIG. 1 after its assembly.

As shown in FIGS. 2 to 4, the second casing member 3 is a box forming a second chamber 30 with an open top. Inside the second chamber 30, there are two parallel, opposing, and upward extending receiving pieces 31, each having a gap 32 extended downward from a top edge.

On a bottom side of the second casing member 3, there are two indentations 33 along two opposing shorter edges of the bottom side, respectively.

The disconnection member 2 is joined to the second casing member 3 with the neck section at each end of the fuse element 21 received by the gap 32 of a receiving piece 31.

The disconnection member 2 is joined to the second casing member 3 with the neck at each end of the fuse element 21 received by the gap 32 of a receiving piece 31. The fuse element 21 is therefore positioned between the two receiving pieces 31. Each electrode 20's C shape is engaged with a lateral side of the second casing member 3, with the second lateral section 202 received by an indentation 33. The first casing member 1 is then joined to the assembly of the disconnection member 2 and the second casing member 3, with the pressing pieces 11 filling the gaps 32 and tightly pressing the necks of the fuse element 21, respectively. The disconnection member 2 is thereby housed in an enclosed space A formed by the first and second casing members 1 and 3.

Figure 5:
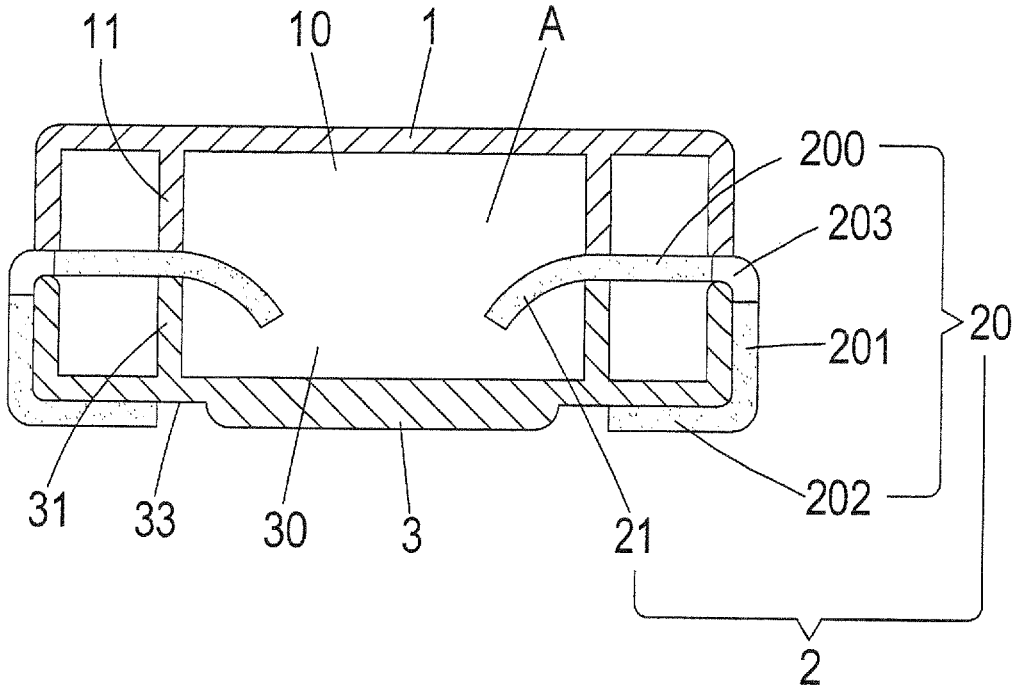
FIG. 5 is a schematic sectional diagram showing the fuse assembly of FIG. 1 after its fuse element breaks off.

As shown in FIG. 5, when the fuse assembly is applied in an electrical appliance, electrical current flows from one electrode 20 to the other electrode 20 through the fuse element 21. When the electrical current exceeds a threshold, the fuse element 21 fuses. As the disconnection member 2 is contained in the enclosed space A, the fuse element 21 could completely break off, thereby avoiding the occurrence of electrical arc.

Furthermore, as each electrode 20 is integrally formed and bended to have the first lateral section 200, the vertical section 201, and the second lateral section 202, the electrodes 20 will not break easily, thereby avoiding the problem of bad contact.

Figure 6:
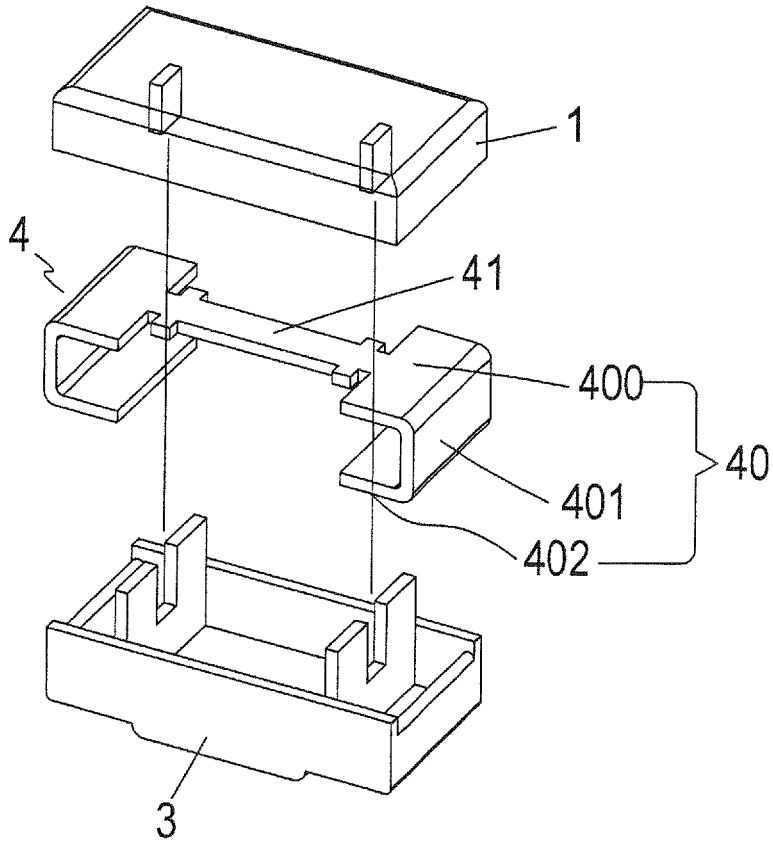
FIG. 6 is a perspective break-down diagram showing the various components of a fuse assembly according to a second embodiment of the present invention.

As shown in FIG. 6, a fuse assembly according to a second embodiment of the present invention contains substantially the same set of components as the first embodiment does and, therefore, the same reference numbers are applied here.

The only difference lies in the disconnection member 4 which also contains two electrodes 40 and a fuse element 41 between the two electrodes 40. Each electrode 40 also contains a first lateral section 400, a vertical section 401, and a second lateral section 402, jointly and integrally forming a C-like shape. Compared to the disconnection member 2 of the first embodiment, the disconnection member 4 of the present embodiment does not have a notch along the junction between the first lateral section 400 and the vertical section 401 of each electrode 40.

Figure 7:
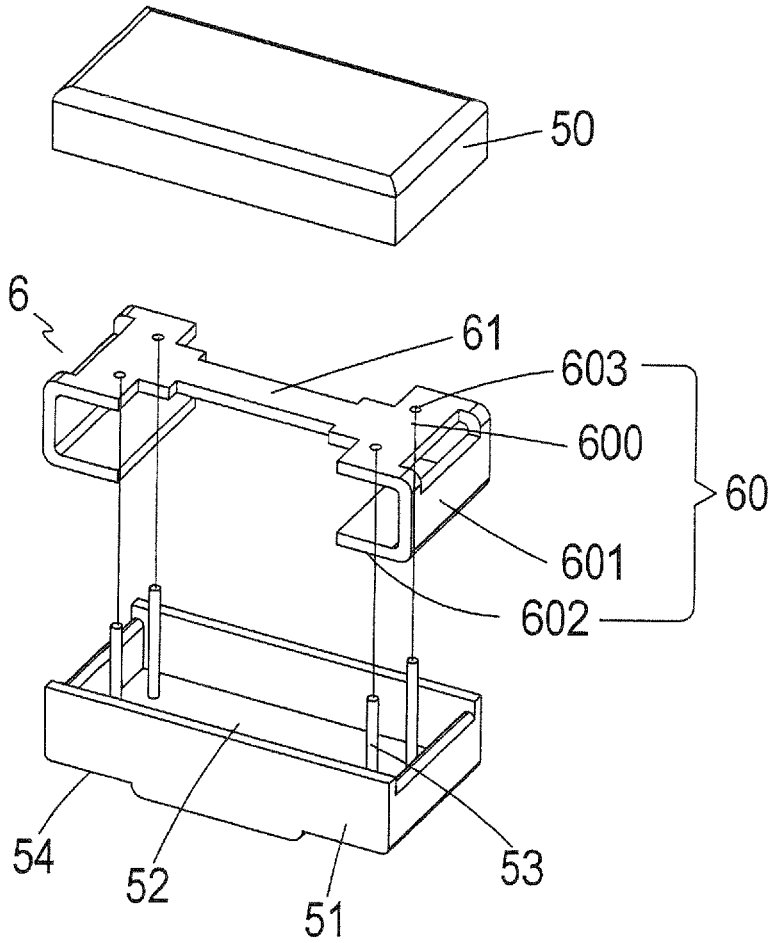
FIG. 7 is a perspective break-down diagram showing the various components of a fuse assembly according to a third embodiment of the present invention.

FIG. 7 depicts a fuse assembly according to a third embodiment of the present invention. As illustrated, the first casing member 50 is a cover forming a first chamber with an open bottom, while the second casing member 51 is a box forming a second chamber 52 with an open top. Inside the second chamber 52, there are a number of upward extending positioning pins 53. On a bottom side of the second casing member 51, there are two indentations 54 along two opposing shorter edges of the bottom side, respectively.

The disconnection member 6 contains two electrodes 60 and a fuse element 61 between the two electrodes 60. Each electrode 60 contains a first lateral section 600, a vertical section 601, and a second lateral section 602, jointly and integrally forming a C-like shape. On the first lateral section 600 of each electrode 60, there are a number of positioning holes 603.

As in the previous embodiments, the disconnection member 6 is positioned between the first and second casing members 50 and 51, and the fuse element 61 is housed in an enclosed space formed by the first and second casing members 50 and 51. The positioning pins 53 thread through the positioning holes 603, respectively, thereby securing the disconnection member 6. The assembly of the disconnection member 6 to the second casing member 51 is identical to the previous embodiment and the details are therefore omitted here.

Figure 8:
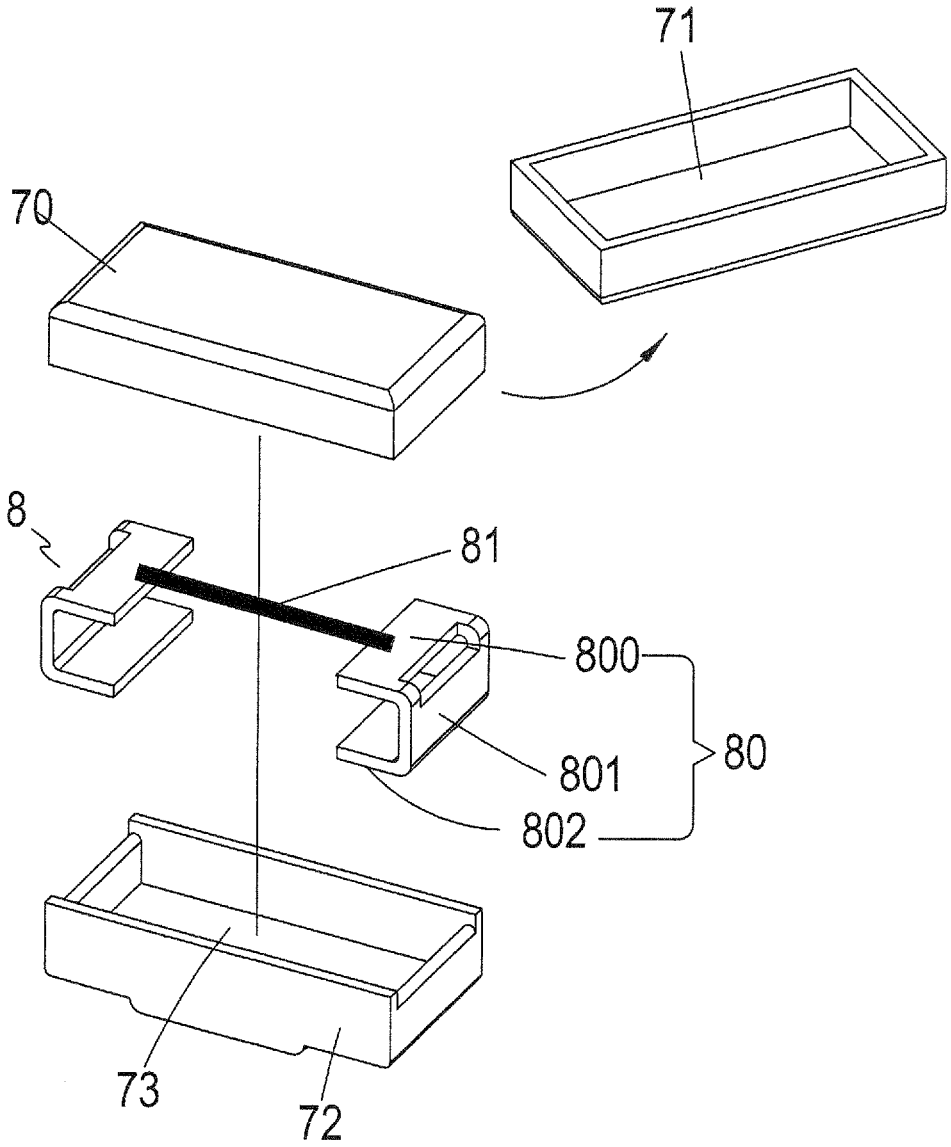
FIG. 8 is a perspective break-down diagram showing the various components of a fuse assembly according to a fourth embodiment of the present invention.

FIG. 8 depicts a fuse assembly according to a fourth embodiment of the present invention. As illustrated, the first casing member 70 is a cover forming a first chamber 71 with an open bottom, while the second casing member 72 is a box forming a second chamber 73 with an open top.

The disconnection member 8 contains two electrodes 80 and a fuse element 81. Each electrode 80 contains a first lateral section 800, a vertical section 801, and a second lateral section 802, jointly and integrally forming a C-like shape. The two ends of the fuse element 81 are connected to the first lateral sections 800 of the electrodes 80, respectively. The fuse element 81 is preferably a fuse filament.

As in the previous embodiments, the disconnection member 8 is positioned between the first and second casing members 70 and 72, and the fuse element 8 is housed in an enclosed space formed by the first and second casing members 70 and 72. Each electrode 80's shape is engaged with a lateral side of the second casing member 72.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A fuse assembly, comprising:

a first casing member having a bottom-open first chamber;

a second casing member having a top-open second chamber; and a disconnection member having two electrodes and a fuse element whose two ends are connected to said electrodes, respectively;

wherein said electrodes are positioned at two opposing ends of said second casing member, respectively; said first casing member is stacked on said second casing member, thereby forming an enclosed space; said disconnection member is sandwiched between said first and second casing members; and said fuse element is housed in said enclosed space; each electrode contains a first lateral section, a vertical section, and a second lateral section, sequentially connected in this sequence; said fuse element is connected to said first lateral sections; at the junction between each end of said fuse element and said first lateral section of an electrode, two opposing slits are provided, thereby forming a neck section between said fuse element and said first lateral section; inside said first chamber, there are two parallel, opposing, and downward extending pressing pieces; inside said second chamber, there are two parallel, opposing, and upward extending receiving pieces, each having a gap along a top edge; said disconnection member is joined to said second casing member with said neck section at each end of said fuse element received by said gap of a receiving piece; and said pressing pieces fill said gaps and tightly press said neck sections of said fuse element, respectively.

2. The fuse assembly according to claim 1, wherein a notch is provided along a right-angled junction between said first lateral section and said vertical section.

3. The fuse assembly according to claim 1, wherein, on a bottom side of said second casing member, there are two indentations along two opposing shorter edges of said bottom side, respectively; and said second lateral sections are received by said indentation, respectively.

* * * * *